US010226156B2

(12) United States Patent
Abdollahzadeh

(10) Patent No.: US 10,226,156 B2
(45) Date of Patent: Mar. 12, 2019

(54) TOILET SEAT CONTROLLER

(71) Applicant: Homayoun Abdollahzadeh, Rancho Mirage, CA (US)

(72) Inventor: Homayoun Abdollahzadeh, Rancho Mirage, CA (US)

( * ) Notice: Subject to any disclaimer, the term of this patent is extended or adjusted under 35 U.S.C. 154(b) by 0 days.

(21) Appl. No.: 14/722,550

(22) Filed: May 27, 2015

(65) Prior Publication Data

US 2015/0366419 A1 Dec. 24, 2015

Related U.S. Application Data

(63) Continuation-in-part of application No. 14/311,628, filed on Jun. 23, 2014, now Pat. No. 9,713,406.

(51) Int. Cl.
*A47K 13/10* (2006.01)
*A47K 13/12* (2006.01)

(52) U.S. Cl.
CPC ..... *A47K 13/10* (2013.01); *A47K 13/12* (2013.01)

(58) Field of Classification Search
CPC ..... A47K 13/10; A47K 13/12
USPC ..... 4/240, 246.1, 246.2
See application file for complete search history.

(56) References Cited

U.S. PATENT DOCUMENTS

| | | | | |
|---|---|---|---|---|
| 1,291,125 | A | 1/1919 | Pope | |
| 2,214,323 | A * | 9/1940 | Carter | A47K 13/10 4/246.2 |
| 2,986,745 | A * | 6/1961 | Melzassard | A47K 13/10 4/246.1 |
| 3,825,958 | A * | 7/1974 | Higginson | A47K 13/10 4/240 |
| 4,055,864 | A | 11/1977 | Liu et al. | |
| 5,119,517 | A | 6/1992 | Chang | |
| 5,289,593 | A | 3/1994 | Lawrence | |
| 5,307,524 | A | 5/1994 | Veal | |
| 5,323,497 | A * | 6/1994 | Lih | A47K 13/10 297/DIG. 10 |
| 5,400,442 | A | 3/1995 | Pendlebury | |
| 5,570,478 | A * | 11/1996 | Armstrong | A47K 13/12 4/246.1 |
| 5,819,327 | A | 10/1998 | Miller | |
| 6,915,532 | B1 | 7/2005 | Mohammed | |
| 7,380,292 | B1 | 6/2008 | Harris | |
| 7,636,956 | B1 | 12/2009 | Doucet | |
| 9,477,317 | B1 | 10/2016 | Clements | |
| 2007/0056084 | A1* | 3/2007 | Watt | A47K 13/10 4/246.1 |
| 2008/0271231 | A1* | 11/2008 | Stauber | A47K 13/305 4/246.1 |

(Continued)

FOREIGN PATENT DOCUMENTS

| | | |
|---|---|---|
| CA | 2772957 A1 | 3/2012 |
| WO | 98/031269 | 7/1998 |

(Continued)

*Primary Examiner* — J. Casimer Jacyna

(74) *Attorney, Agent, or Firm* — Knobbe, Martens, Olson & Bear LLP

(57) ABSTRACT

An apparatus capable of moving a toilet seat from one position to another in a number of ways including, but not limited to, a switch, voice recognition software, infrared remote control, a motion detector, and a mobile device application. A lifting structure is attached under the seat and is connected to a housing containing a motor and/or a microprocessor.

12 Claims, 13 Drawing Sheets

(56) References Cited

U.S. PATENT DOCUMENTS

| | | | | |
|---|---|---|---|---|
| 2009/0106885 | A1* | 4/2009 | Sagre | A47K 13/10 4/246.1 |
| 2010/0313343 | A1 | 12/2010 | Kang | |
| 2012/0167292 | A1 | 7/2012 | Baumoel | |
| 2012/0246812 | A1* | 10/2012 | Blum | A47K 13/245 4/246.1 |
| 2013/0007952 | A1* | 1/2013 | Gomez-Espana Collignon | A47K 13/10 4/246.2 |
| 2015/0366418 | A1 | 12/2015 | Abdollahzadeh | |

FOREIGN PATENT DOCUMENTS

| | | |
|---|---|---|
| WO | 2009/054862 | 4/2004 |
| WO | 2004/100745 | 11/2004 |
| WO | 2014/036523 | 3/2014 |

* cited by examiner

TOILET SEAT CONTROLLER

BACKGROUND OF THE INVENTION

Field of the Invention

The invention disclosed herein relates generally to electronic devices attachable to, and capable of moving, toilet seats. The invention relates specifically to a system capable of moving a toilet seat between a first open position and a second closed position upon receiving commands.

Description of Related Art

Toilet seats are unclean at best and a harbor for disease at worst. A man wishing to use a toilet runs the risk of infection and illness, as does a woman faced with having to put the seat down if a man with whom she is sharing the premises forgets to do so. To avoid having to do this, it is desirable to have at one's disposal a device that can be attached to a toilet seat. More importantly, it is desirable to have a device that can also be manipulated at will should the device or the entire toilet need to be cleaned or repaired. The prior art discloses a number of devices that seek to achieve these objectives.

For example, U.S. Pat. No. 5,289,593 to James Lawrence discloses a seat-closure device that involves weight-driven cords or cables that move the toilet seat when the toilet is flushed. U.S. Pat. No. 5,400,422 to James Pendlebury discloses a hydraulic motor-driven device that also lowers the toilet seat upon flushing. Other patents disclose various methods to affix similar devices to a toilet that utilize, for example, springs, or movement based on the water line in the tank, among others, to restore the toilet seat to its original position.

Unfortunately, the prior art overwhelmingly favors simplistic methods such as cables with weights and water markers. Two issues arise as a result of these methods. First, many necessarily require a tank. This requires more labor to install and remove the device and it also makes the functioning of the device dependent on the functioning of the tank. Second, even if the prior art devices do not require a tank to work, they cannot be retrofitted onto an existing toilet, instead requiring a new seat to be installed. While these methods certainly fulfill the purpose of moving the seat from one position to another during routine use, they do not address the need for manipulating the seat at will should the user need to wash or repair the toilet or the device.

SUMMARY OF THE INVENTION

The invention that is the subject of this application overcomes the shortcomings of the prior art by providing the user with a number of convenient ways to control the seat's movement that include both motion-based methods and methods that involve more direct control of the device.

The disclosed invention comprises an apparatus for controlling the movement of a toilet seat. A housing contains a microprocessor and a motor and is coupled to a toilet seat. The housing is also coupled to, or rests on the toilet base. The motor uses energy to move the toilet seat from a first open position to a second closed position. A tongue is affixed beneath a toilet tank and anchors the housing in place. A lifting structure in communication with the motor is affixed beneath the toilet seat and to the housing.

BRIEF DESCRIPTION OF THE DRAWINGS

The invention will be more fully understood by reference to the following drawings which are for illustrative purposes only.

DETAILED DESCRIPTION

Figure 1:
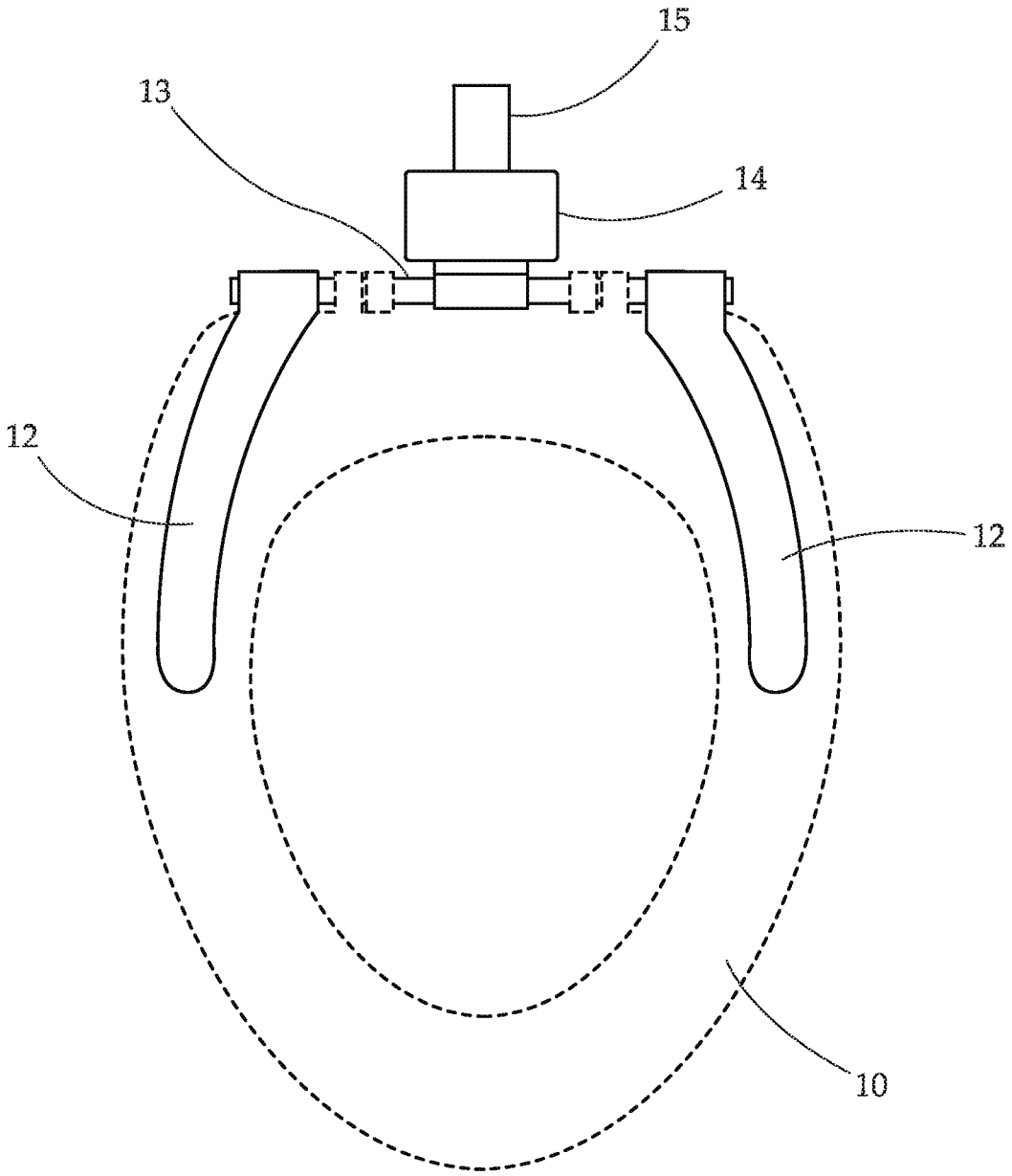
FIG. 1 provides a top plan view of a standard toilet seat and one embodiment of the disclosed invention with the position of the arms affixed to the seat in phantom lines.
Figure 2:
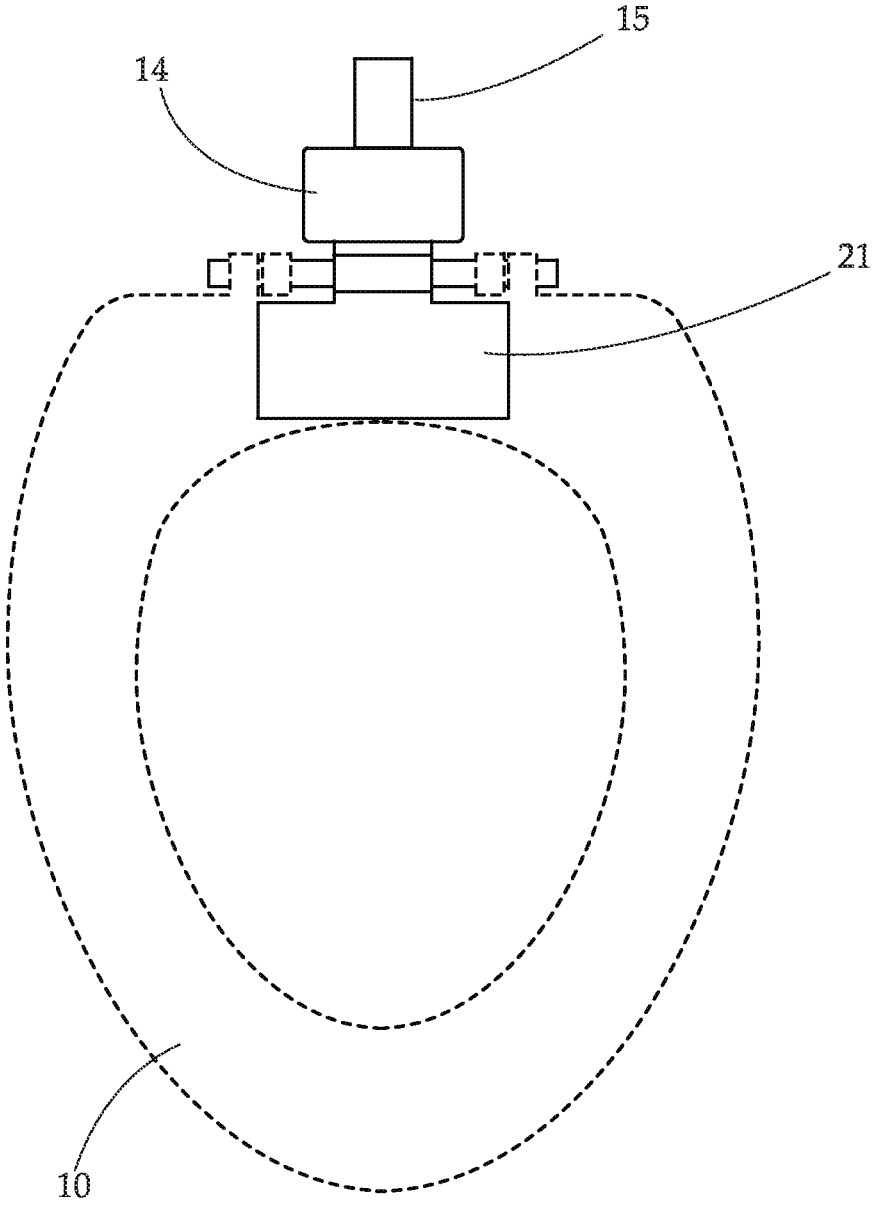
FIG. 2 provides a bottom plan view of one embodiment of the disclosed invention showing the motor, the tongue, and a cuboid-shaped lifting structure attached to the bottom of the seat.

The detailed description set forth below in connection with the appended drawings is intended as a description of presently preferred embodiments of the invention and does not represent the only forms in which the present invention may be constructed and/or utilized.

The invention comprises a device configured to open and close a toilet seat. The device is configured to be attached to a toilet having a base, a bowl, a tank, and the toilet seat movable from a first open position to a second closed position. The device comprises a housing, containing a motor and an optional microprocessor. The housing is connected to a lifting structure attachable to the base of any standard toilet seat such that it is entirely, or mostly, not visible. This lifting structure is attachable to the seat by any means including, but not limited to, Velcro®, adhesives, threaded connections, and mounted brackets. It is an important feature of the present invention that it can be installed allowing existing toilets to be retrofitted with the invention. As long as the lifting structure supports the toilet seat's weight, it can be shaped in any desired manner including, but not limited to, a cuboid-shaped block, arms that extend from the motor to a desired point on the seat base, or a crescent.

Attached to the housing on the side opposite the side to which the lifting structure is attached is a tongue that is placed under the tank to keep the housing in place while the seat is in motion. In addition, the housing is also affixed to the rear portion of the toilet seat by any means including, but not limited to, Velcro®, adhesives, threaded connections, or mounted brackets. The microprocessor has the ability to respond to commands to lower or raise the seat in at least three ways: A switch mounted near or on the toilet, a motion detector, and voice recognition software. The user can elect to use any of these methods to operate the device. However, it should be understood that any input may be used to activate the motor without straying from the scope of this invention.

Referring now to FIGS. 1-9, the present invention is powered by a motor that acts upon commands delivered to a microprocessor. The motor and/or the microprocessor are in a housing 14 that is affixed to the rear section of the toilet base, near the tank. The housing 14 comprises a lifting structure 12, 21, 31, that connects the seat 10 to the housing 14. The lifting structure may be affixed to the seat 10 by any means including, but not limited to, Velcro®, adhesives, threaded connectors, and mounted brackets. In alternative embodiments, the user's choice of affixation can be determined by a number of factors. First, ease of installation and removal. Velcro® and adhesives are quicker methods of installation than threaded connections or mounted brackets. Second, and closely related to the first factor, is the degree to which the user wishes the device to be permanently attached to the toilet. Velcro® is a less permanent method of affixation than threaded connections, for example.

Attached to the opposite side of the housing 14 is a tongue 15 that extends into the crevice underneath the tank and above the body of the toilet. The tongue 15 serves to anchor the housing 14 in place when the seat 10 is in motion and being acted on by the motor engine. The tongue 15 can be coupled to the housing 14 by any means necessary to enable the device and the seat 10 to achieve the full range of motion. For example, in one embodiment, the housing 14 may include a crevice of any shape but sufficiently large to accommodate the portion of the tongue 15 with which it is coupled. A pin may be installed within this crevice and holes corresponding to the pin's diameter may be drilled through the tongue's 15 rear portion. The tongue 15 will be affixed to the pin allowing the housing to rotate about the pin. By way of example only, and for purposes of further demonstration to those of skill in the art, this particular embodiment is based on largely the same principle as the functioning of a clevis pin. In another embodiment, the tongue 15 could also be an integrally formed extension of housing 14.

In another embodiment, the tongue 15 may be coupled to the housing 14 by installing it in a crevice designed to accommodate a range of motion of at least 90°. The tongue 15 can then be coupled directly to the housing 14 by way of, for example, a threaded connection such as nuts or screws, or by rotating about a pin that is installed through that anterior portion of the tongue 15 and anchored in the crevice of the housing 14. The connection will hold the tongue 15 in place while allowing the housing to rotate.

Figure 3:
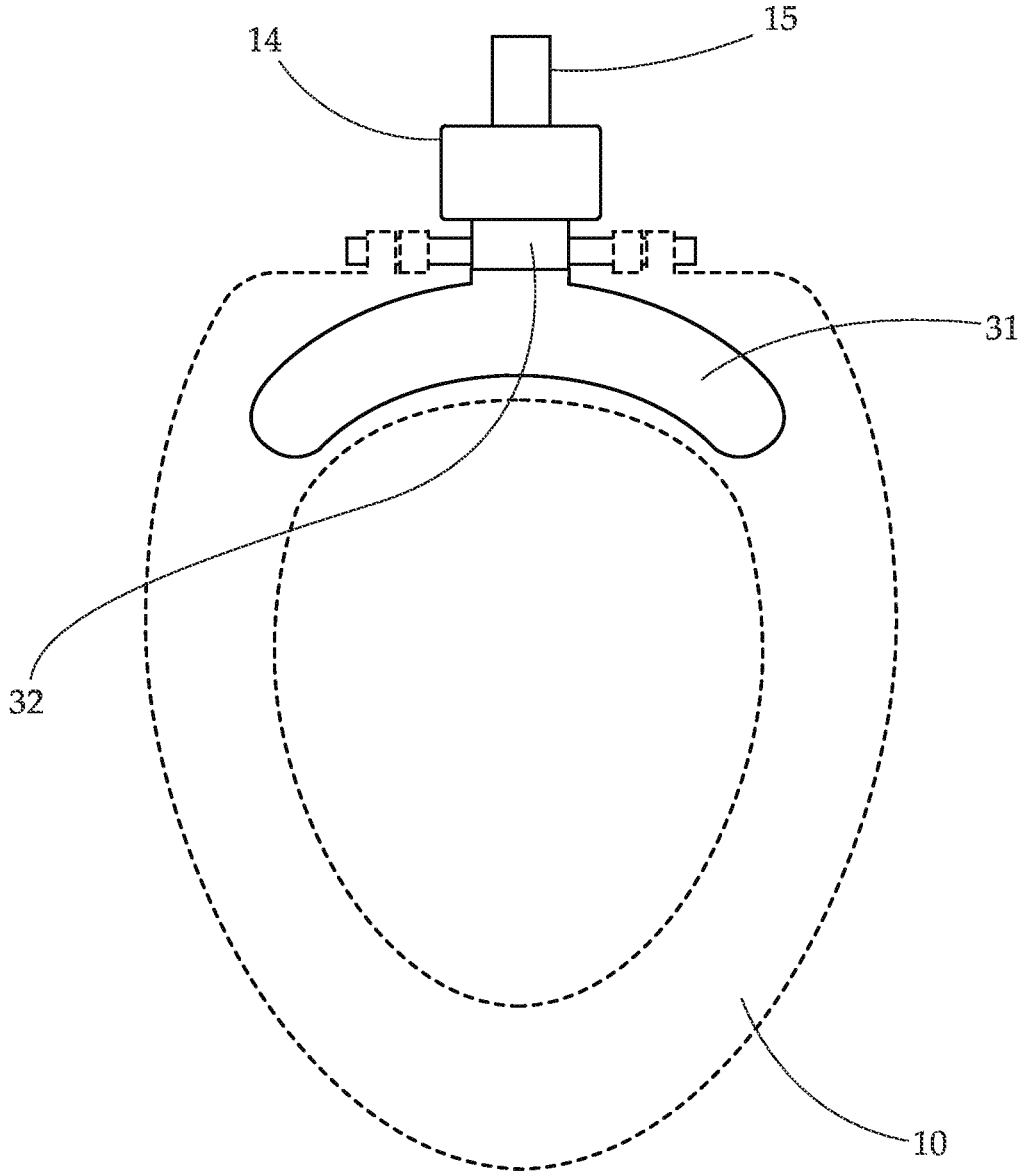
FIG. 3 provides a bottom plan view of another embodiment of the disclosed invention showing the motor, the tongue, and a crescent-shaped lifting structure attached to the bottom of the seat.
Figure 4:
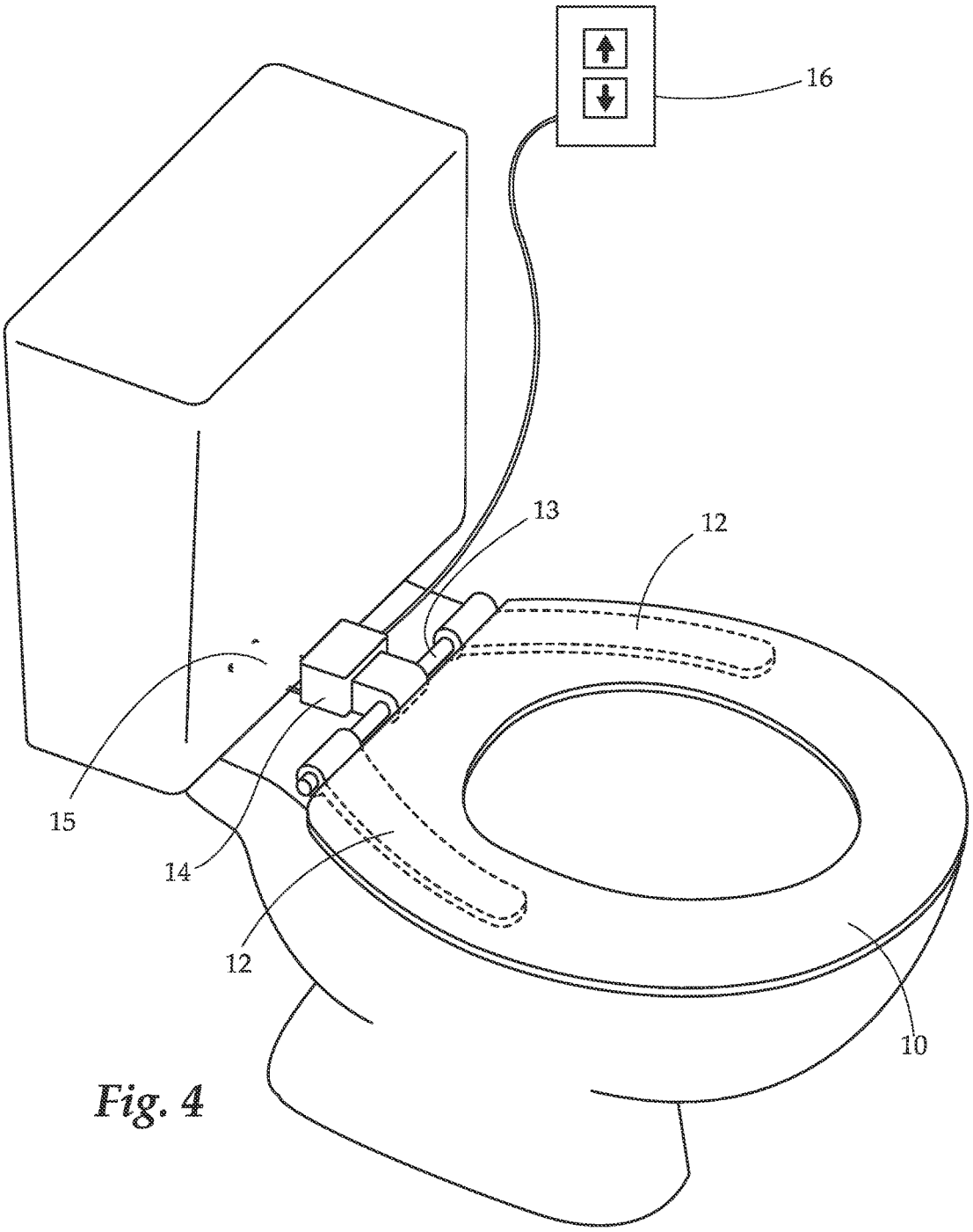
FIG. 4 provides a perspective view of an embodiment of the present invention.
Figure 5:
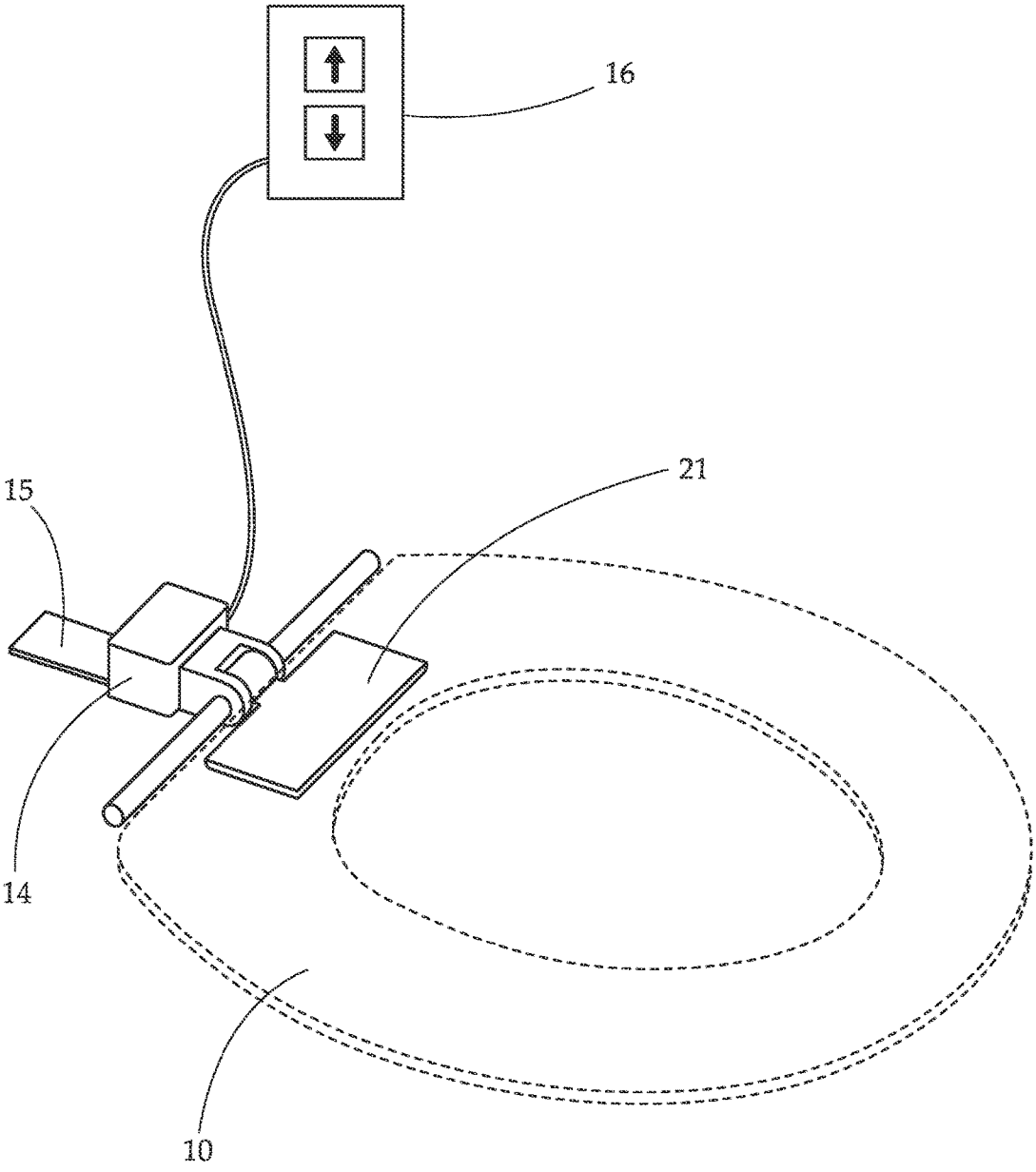
FIG. 5 provides a perspective view of still another embodiment of the present invention.
Figure 6:
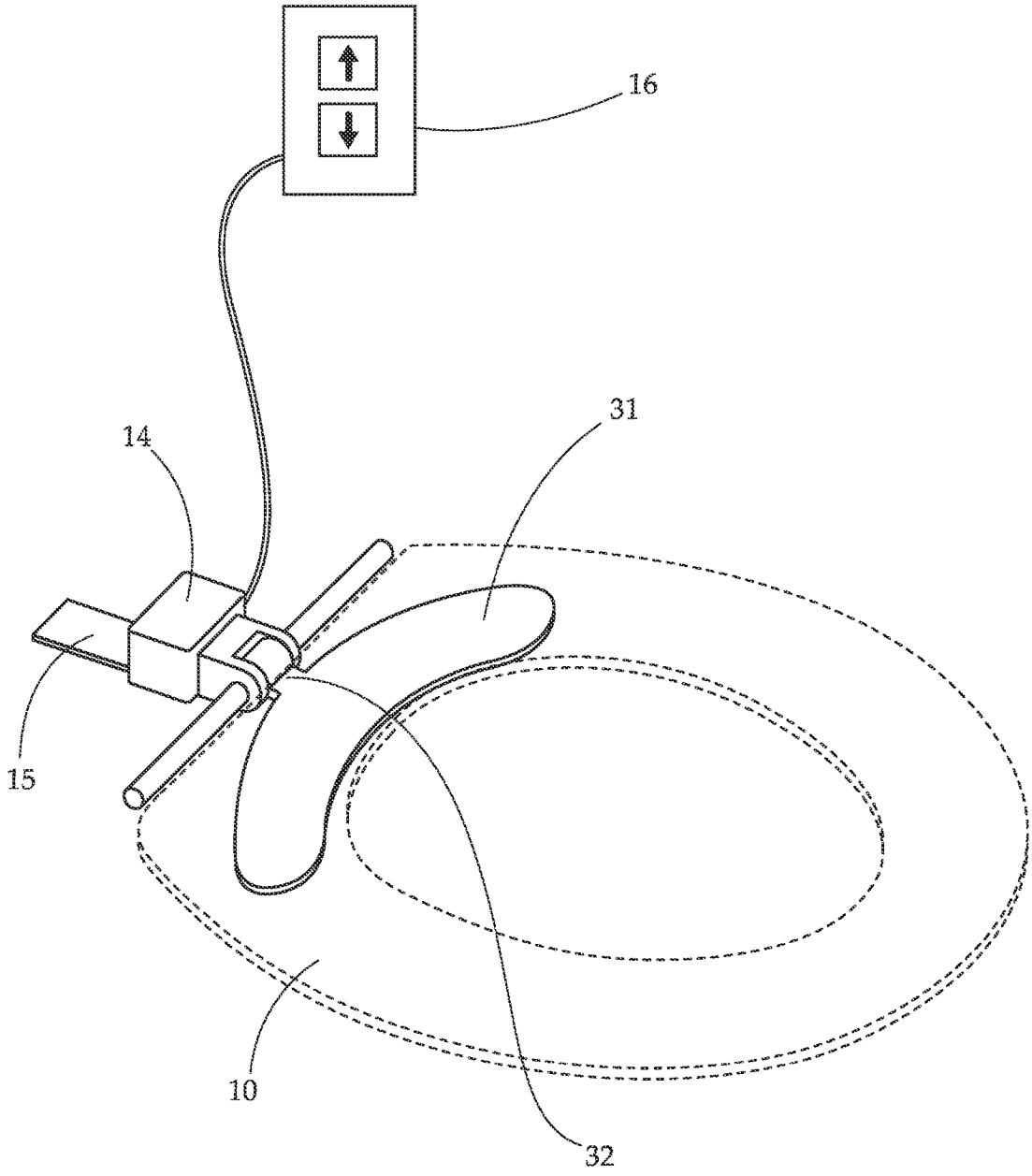
FIG. 6 provides a perspective view of another embodiment of the present invention.
Figure 7:
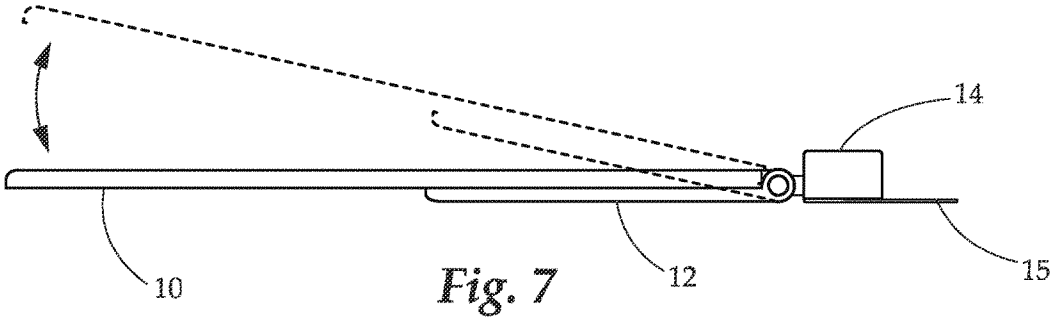
FIG. 7 provides a side view of another embodiment of the present invention.
Figure 8:
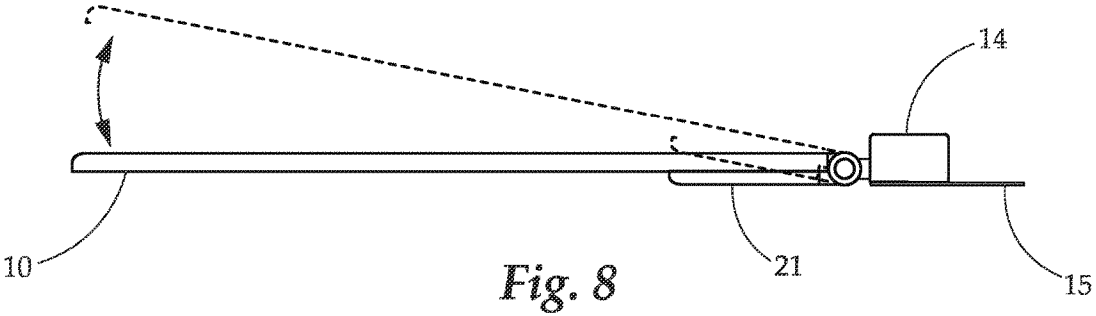
FIG. 8 provides a side view of another embodiment of the present invention.
Figure 9:
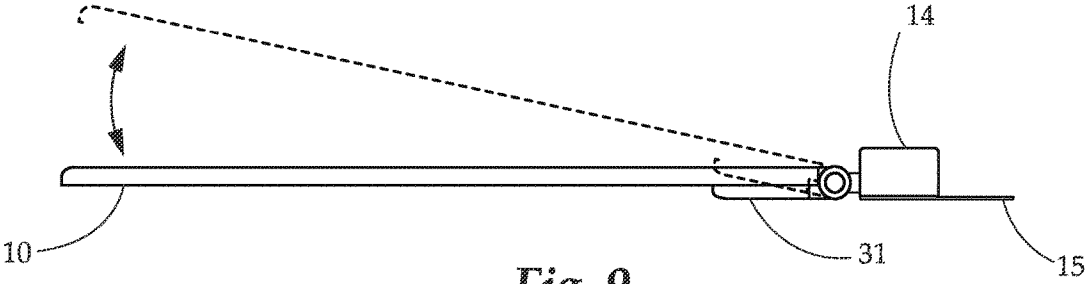
FIG. 9 provides a side view of another embodiment of the present invention.

Those of ordinary skill in the art will appreciate that despite the anchoring of the housing 14 as described above, the lifting structure will need to be constructed such that the housing 14 can be securely attached to it. This is necessary to minimize physical stress on the housing 14 and the lifting structure. FIGS. 1, 4, and 7 display one embodiment containing a bar 13 connecting the lifting structure 21 to the housing 14, the lifting structure 12 connecting the bar 13 and the seat 10. FIGS. 3, 6 and 9 displays another embodiment containing this bar 32 in between the housing 14 and the seat 10. Those of skill in the art will note the significant difference in size between bars 13 and 32 in these embodiments. Regardless of the bar or other connector's size, it may be attached to the housing 14 on one side and the lifting structure 12, 21, 31 on the other by any suitable method. For example, the housing 14 can be attached to the lifting structure which is formed as a bar or rectangular plate that contains the method of affixation to the back of the seat 10 on one side. In one embodiment, the housing 14 can be attached by threaded connectors to part of the lifting structure, which is a bar of suitable rigidity and material with a certain number of mounted brackets that are attachable to the seat 10. In another embodiment, the housing 14 can be attached by threaded connections to a bar of suitable rigidity and material and the bar contains one side of a number of adhesive patches with corresponding adhesive patches attachable to the back of the seat 10. It should be understood, however, that the lifting structure may be attached to the housing by any means without straying from the scope of this invention, so long as the lifting structure and is allowed to be moved approximately 90 degrees between the open and closed positions by the motor of the housing. The bar's length can be as desired and its width can be wider than the back of the seat 10 to ensure there is enough room for, both, the chosen method of affixation and the point at which the lifting structure is to be attached.

In one embodiment, an upper portion of one side of the bar or rectangular plate is devoted to the chosen method of affixation while the lower portion is devoted to attaching the lifting structure. The dimensions of the bar, the location of the method of affixation, and the location of the lifting structure will depend on the structure of the particular toilet and its seat 10 as well as the choice of lifting structure.

The lifting structure can be any shape or size suitable to support the weight of a standard toilet seat 10. Those of skill in the art will appreciate that a toilet seat 10 is not particularly heavy, which allows a vast choice of materials and shapes to be used to manufacture the lifting structure. In one embodiment, illustrated in FIGS. 1, 4, and 7, the lifting structure consists of two arms that extend a certain distance outward. In another embodiment, illustrated in FIGS. 2, 5, and 8, the lifting structure 21 is a rectangle or cuboid. In yet another embodiment, illustrated in FIGS. 3, 6 and 9, the lifting structure 31 is a crescent shape. In each embodiment, the lifting structures are attachable to the toilet seat 10 by any suitable method including but not limited to Velcro®, adhesive, threaded connectors, or mounted brackets.

The seat 10's movement can be controlled in a variety of ways. In one embodiment, the housing 14 does not contain a microprocessor and the mode of operation is a simple switch/sensor button. In another embodiment, a microprocessor in the housing 14 may be responsible for receiving commands and performing the desired operation. The microprocessor can be programmed to receive commands in at least three ways: A switch mounted near the toilet, a sensor, and voice recognition. A user can select the method of command by any appropriate method common to such technology, including, but not limited to, pressing a button on the housing 14 corresponding to the desired mode of operation or turning a dial installed in the housing 14 that corresponds to the desired mode of operation.

If the user should choose a switch as the primary mode of operation, the switch can be mounted on the wall nearest to the toilet, for example. A two-switch embodiment 16 is illustrated in FIG. 4. In this embodiment, one switch can be used to raise the seat 10 while the other can be used to lower it. In another embodiment, a single switch can be used to start movement and can be pressed again to stop movement when desired or when the seat 10 completes its full range of motion. This may help the user to stop the seat's 10 movement when and where desired to facilitate cleaning or repair. The switch 16 can be mounted by any appropriate means including but not limited to adhesives, Velcro®, or suction cup technology.

If the user chooses the sensor as the primary mode of operation, then a motion detector, infrared sensor, wireless transceiver, or the like, built into the housing 14, or separate and in communication with the microprocessor, will detect and respond to various inputs. This may be a particularly suitable mode of operation for routine use as opposed to a situation in which the user wishes to clean or repair the toilet or the seat 10.

If the user chooses voice recognition as a primary mode of operation then the seat 10 will respond to simple voice commands. In one embodiment, users can record spoken commands into a recording device built into the housing 14, each of which can correspond to a particular movement. For example, the command "Down" will lower the seat 10, the command "Up" will raise the seat 10, and the command "Stop" will cause the seat 10 to remain in the position it was in when the user uttered the command "Stop." Alternatively, programmed voice recognition software may be used in communication with the microprocessor, stored in a memory, to accept verbal commands without voice recording or other specific training.

It will be understood by those skilled in the art that additional modes of command may be programmed into the microprocessor and incorporated into the system. One example is remote control technology. Another example is mobile application software. A user can transmit commands to the microprocessor in any method appropriate, including, but not limited to, using a touch-screen to control the movement of the seat or issuing verbal commands directly into a mobile device, which will then relay the command to the microprocessor. This particular mode of command is particularly useful if the user wishes to raise or lower the seat 10 when outside the restroom. For example, the user may require the seat 10 to be raised before he enters the restroom or may remember that he forgot to lower the seat 10 only after he leaves the restroom.

Figure 10:
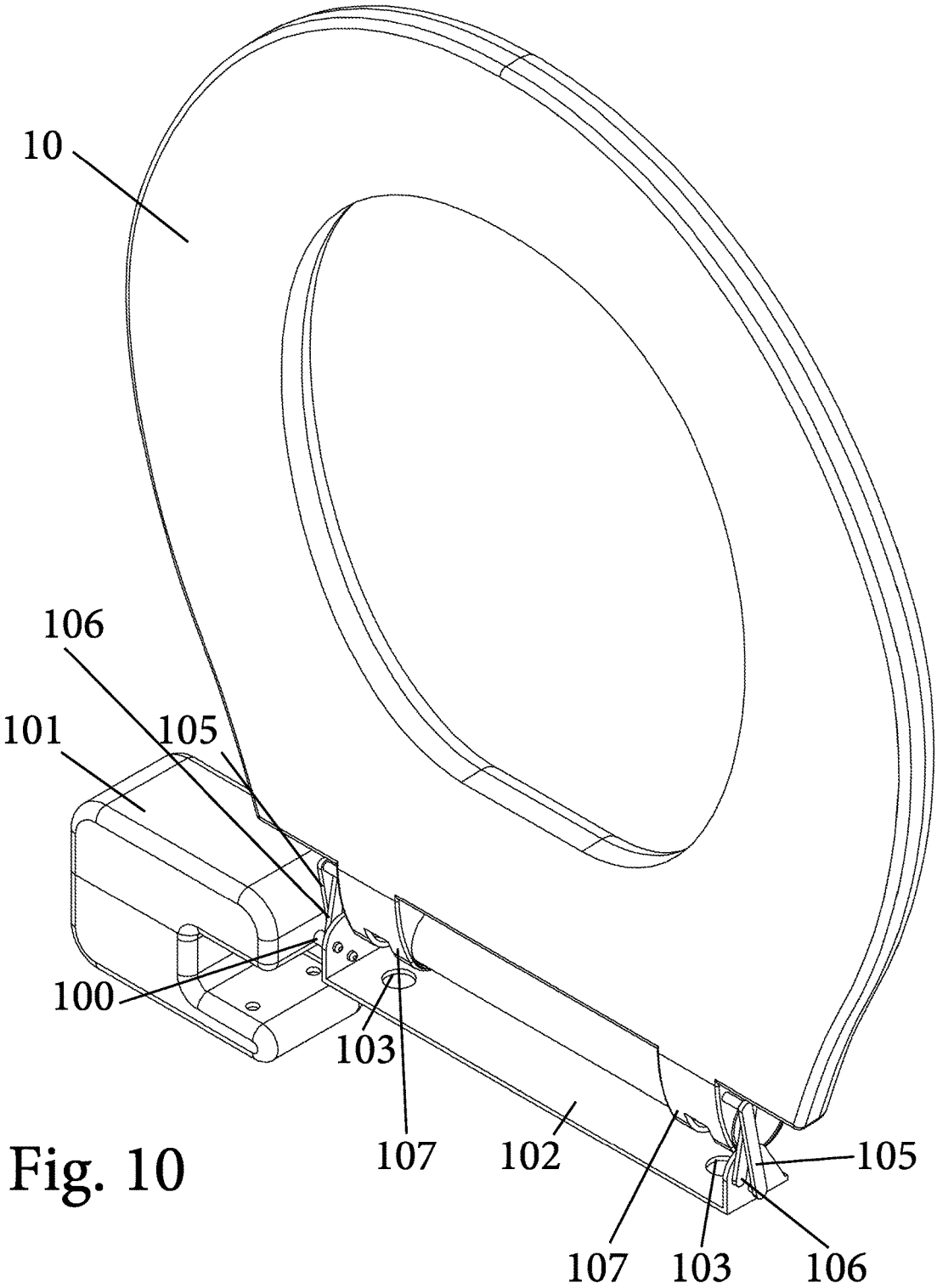
FIG. 10 provides a perspective view of still another embodiment of the present invention.

Turning to FIG. 10, another embodiment of the present invention is provided. In this embodiment, two levers 105, 106 on each side of the toilet seat 10 control the seat's movement with the aid of a rotary motor. The two levers 105, 106 create a virtual pivot point, allowing the toilet seat 10 to rotate on an axis through connection to the axis by connectors 107. One lever 106 is connected to a rotary motor 101 by drive shaft 104. The seat 10 has a connector plate 102 to which the remaining levers 106, 105 are attached. Connector plate 102 further defines two apertures 103. These apertures 103 allow a bolt to pass through and into the toilet basin (not shown). In one embodiment, the apertures 103 are spaced apart by approximately 5½ inches apart, with a tolerance of ½" inch on each aperture 103. This connection structure may be used by any of the other embodiments discussed herein. Further, rotary motor 101 forms a seat in which a portion of the toilet basin may be received. This seat provides an anchor and leverage for the rotary motor. However, it should be understood that the rotary motor 101 may be attached to the toilet in any manner.

Figure 11:
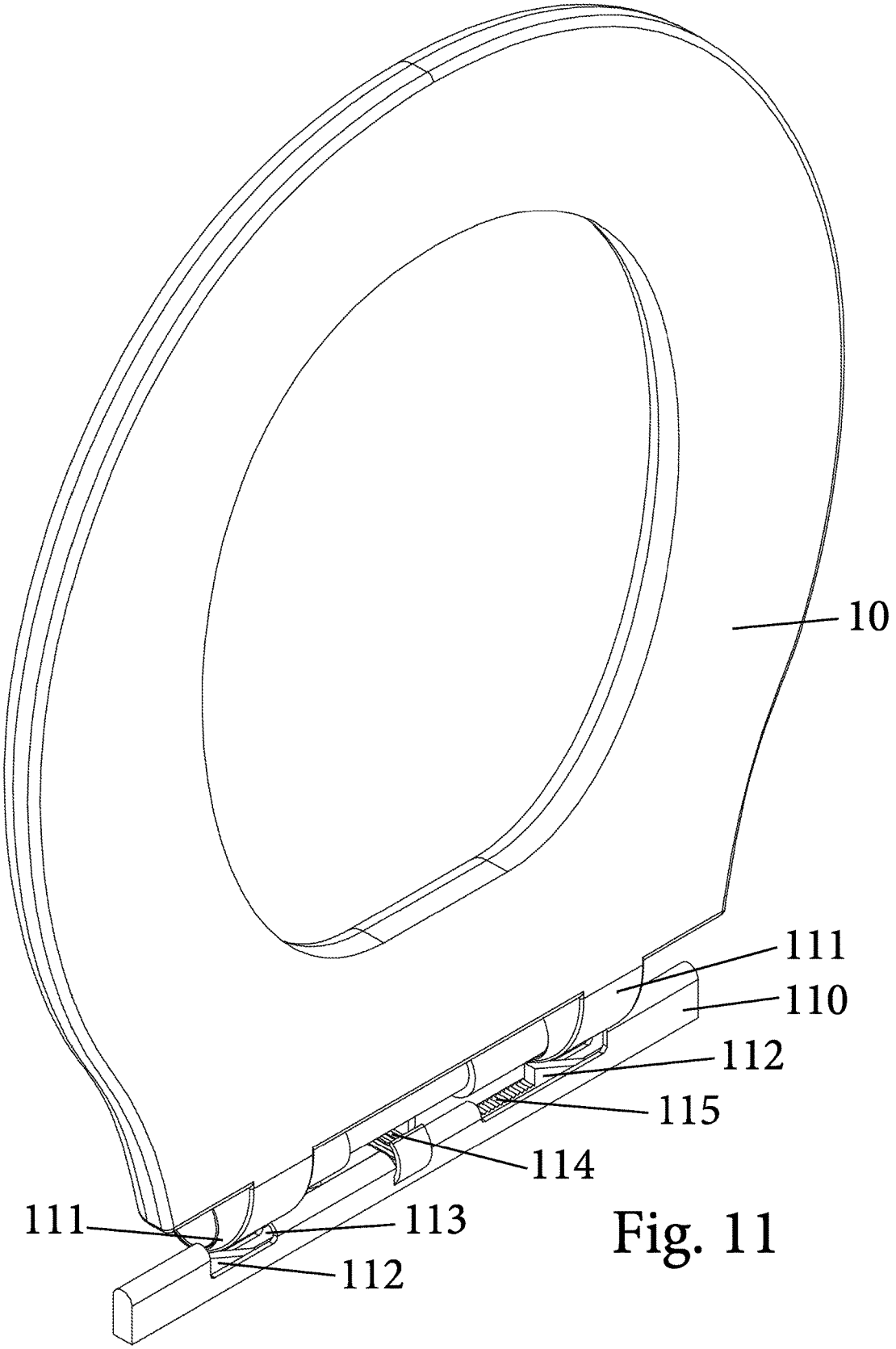
FIG. 11 provides a perspective view of yet still another embodiment of the present invention.

FIG. 11 provides yet another embodiment of the present invention. In this embodiment, a cam slope is movable across a width of the seat to provided movement of the toilet seat. In this view, seat 10 comprises two curving connectors 111 which connect the seat 10 to an axis about which it rotates. A base 110 is connectable to the toilet (not shown). Within the base, an elongate member is housed. The member comprises a toothed surface 115 which interfaces with gear 114. Gear 114 is connected to a rotary motor (not shown) and when rotated, causes the member to move to the left or right relative to seat 10. Cam surfaces 112 are positioned on the member in openings 113 underneath connectors 111. Upon movement of the cam surfaces 112, the curved connectors, and in turn the seat connected thereto, are urged upwards or allowed to move downwards into an open or closed position.

Figure 12:
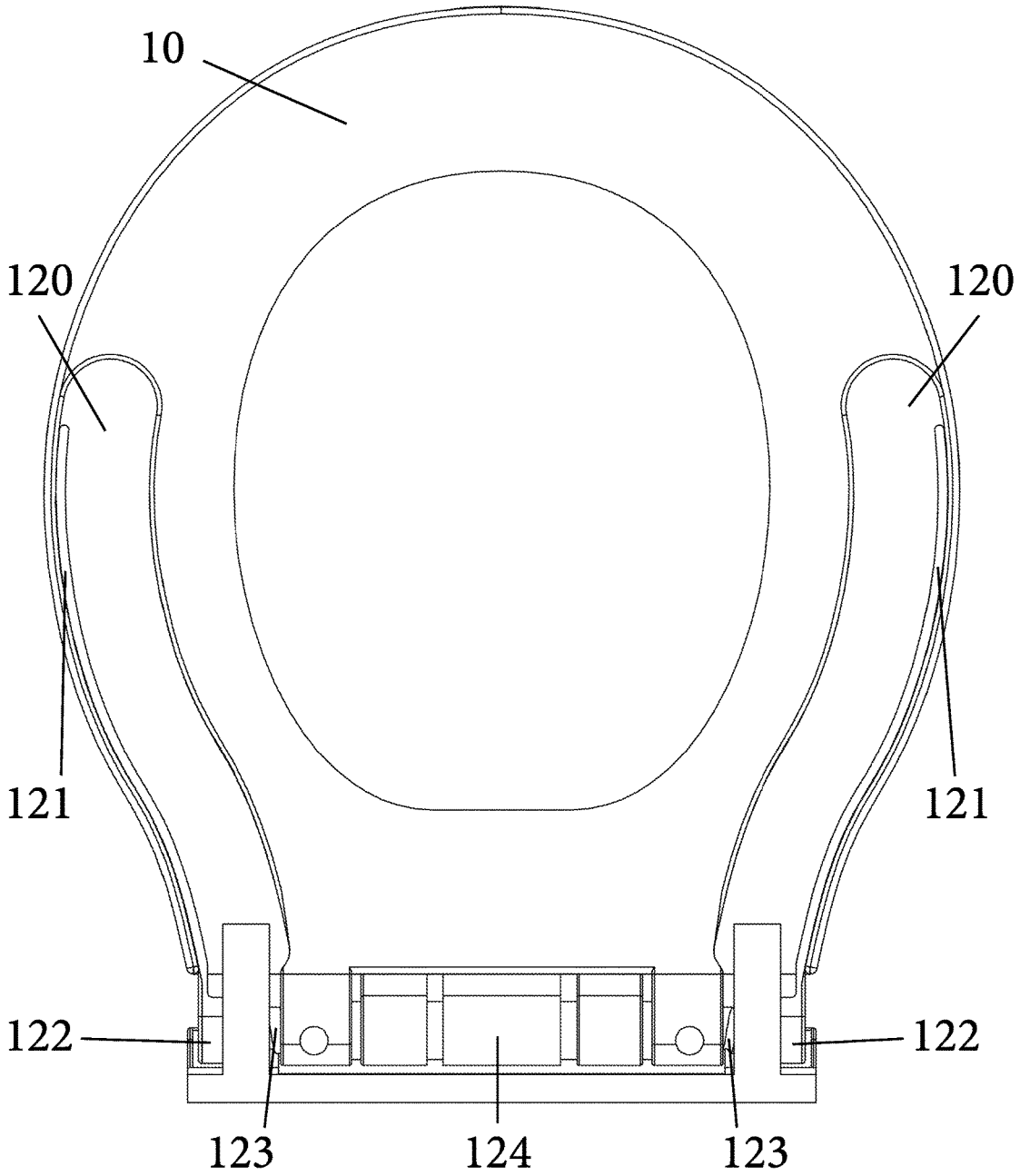
FIG. 12 provides an elevation view of still another embodiment of the present invention.
Figure 13:
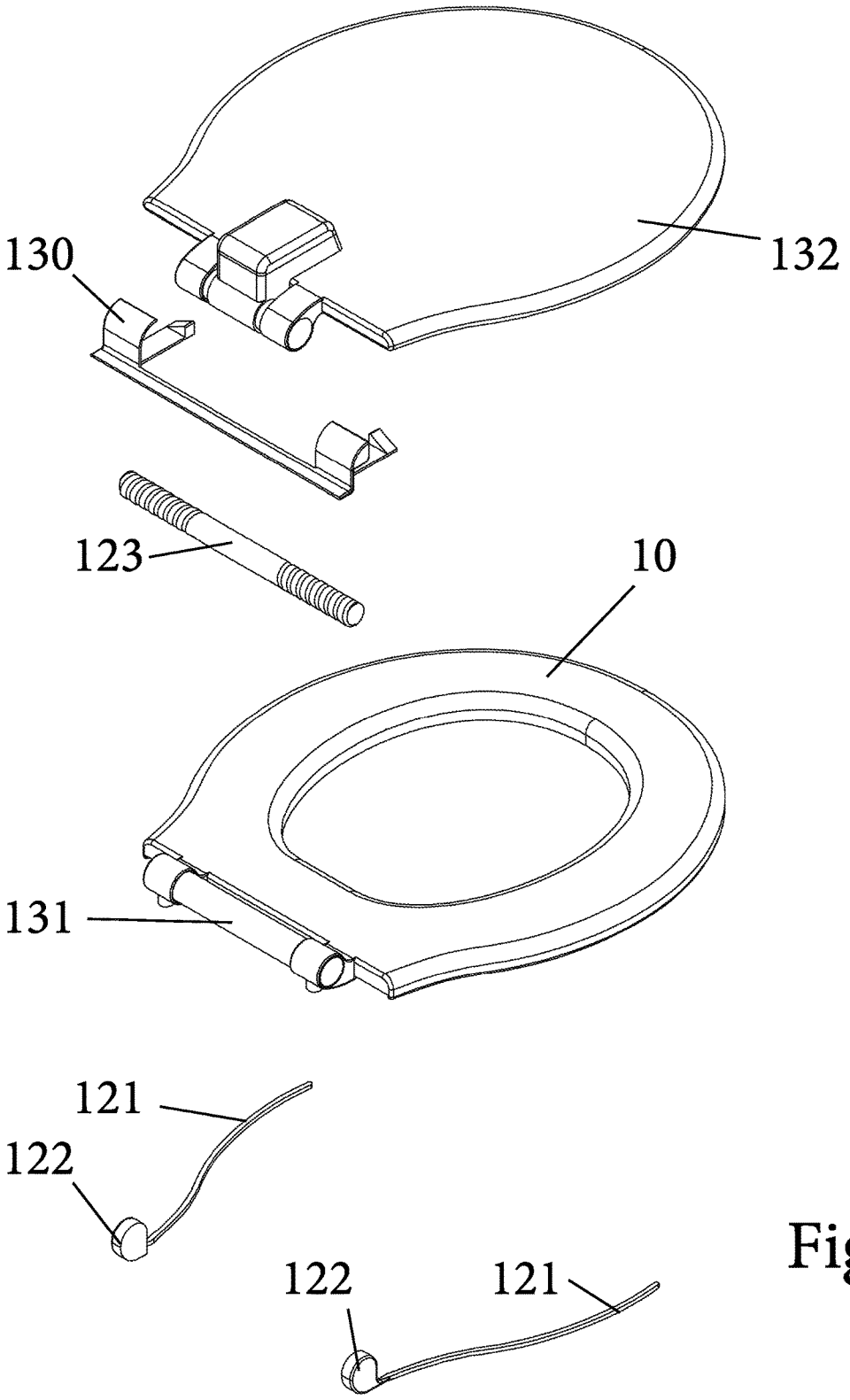
FIG. 13 provides an exploded view of the embodiment shown in FIG. 12.

FIGS. 12 and 13 provide another view of an embodiment of the present invention. In this embodiment, a contra rotating screw 123 rotates two rods 121, connected thereto, which are positioned against the seat 10 in seats 120. Screws are seated within end hinged axle 124 and extend out both sides, and driven by a drive motor (not shown). When the contra rotating screw 123 rotates, the rods 121 begin to bend against the toilet seat. As they bend, the rods 121 make contact with a ramp seat 120, guiding the seat 10 upwards. When the seat 10 is lowered, the contra rotating screw 123 has its motion reversed, allowing the rods to relax.

Figure 14:
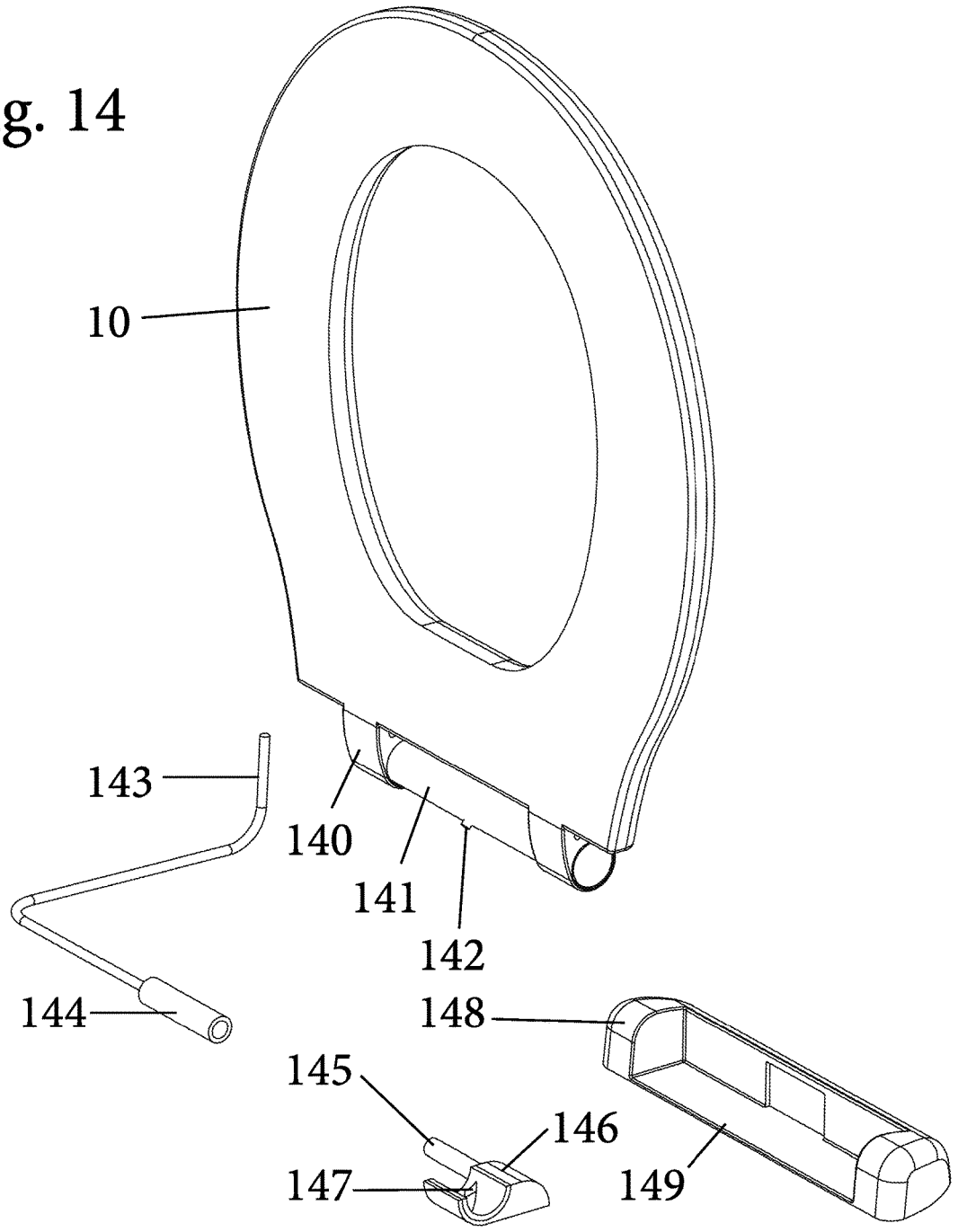
FIG. 14 provides a perspective exploded view of still another embodiment of the present invention.
Figure 15:
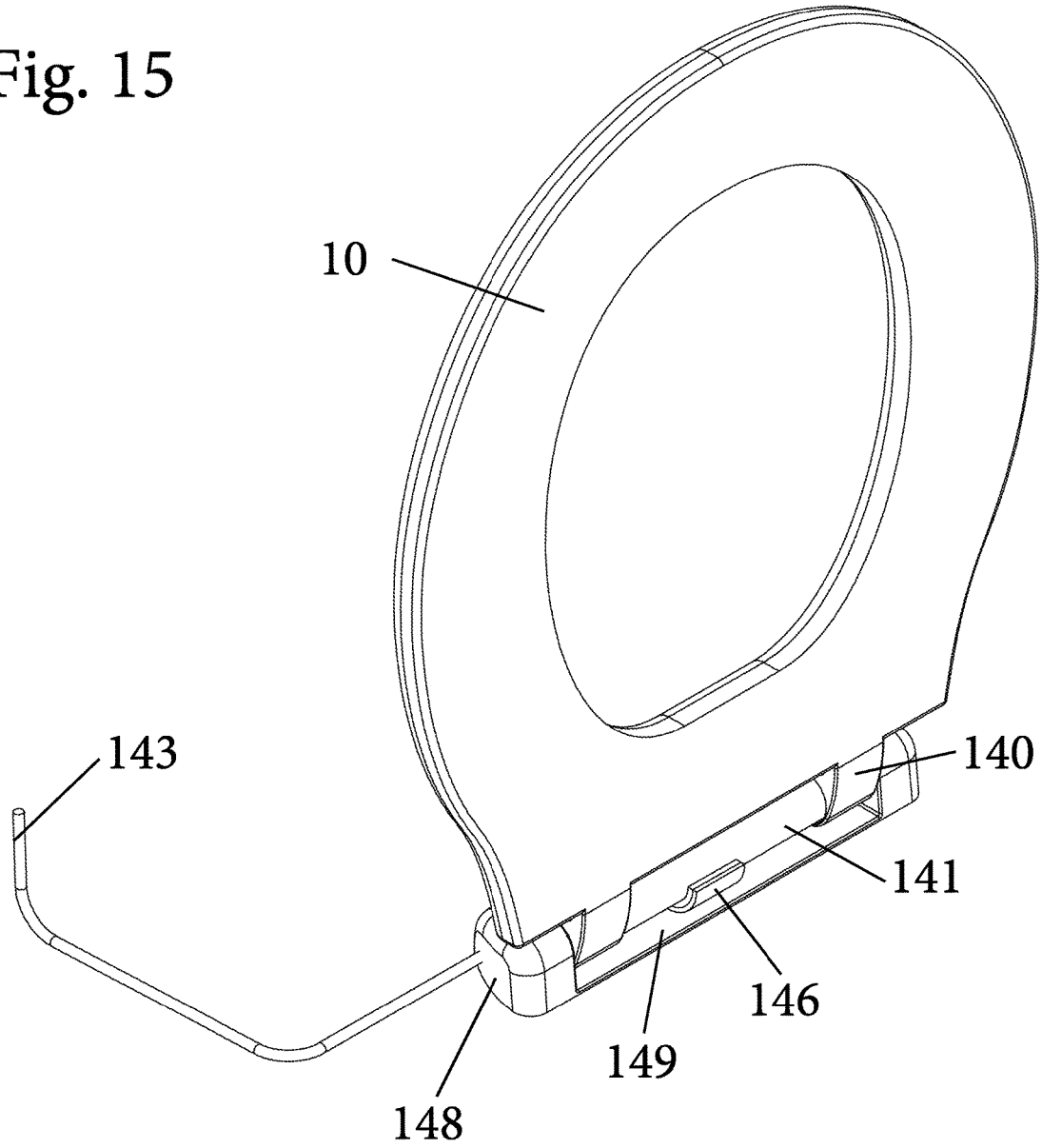
FIG. 15 provides an exploded view of the embodiment shown in FIG. 14.

FIGS. 14 and 15 provide still another view of an embodiment of the present invention. In this view, a pin 142 extending from the axle 141 seats into a cam slot 147 which forms a path defined by a curved region of an axle receiver 146. In its open position, the pin 142 is pushed to the right by a movable element (not shown) and forward, causing the seat to rotate at the same time. This positioning is reversed in the closed position. A movable element (not shown) is within the cam slot 147 and interfaces with pin 142. This movable element is in communication with a motor (not shown), or other power source. The toilet seat has a housing 148 which defines a receiving area 149 to receive the axle 141 and connectors 140. The movement of pin 142 in the cam slot 147 is activated by a motor (not shown) in communication with line 143, rotating connector 144. Rotating connector 144 connects to the axle receiver 146 via an interfacing receiver 145. The connector and receiver contain internal components (not shown) which allow transfer of a rotating movement from connector 144 to receiver 145. In the embodiment shown, line 143 is a hydraulic line providing flow from a hydraulic system (not shown). This hydraulic line powers the connectors 144, 145, and thus movement of the pin 142 in the axle receiver 146. In a particular embodiment, a visual sensor may be used to trigger actuation of the seat movement. In a further particular embodiment, two sensors may be provided, such that motion in front of a first sensor triggers an upward movement of the toilet seat, while motion in front of a second sensor triggers a downward movement of the toilet seat.

In yet another embodiment, at least one light-sensitive light-emitting diode (LED) will be built into the housing to illuminate the device if the user happens to be using the facility in the dark. In order to save power, the LED may be in communication with the motion detector such that it will emit light only when a user is about to use the facility in the dark.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A compact electronic toilet seat assembly attachable to an existing toilet, comprising:

a toilet seat;

an axle member;

a plurality of connectors, said connectors attached to the toilet seat and pivotably coupled to the axle member in a manner such that the axle member extends between the connectors and rotation of the axle member along a longitudinal axis causes movement of the toilet seat;

a pin extending orthogonally from the longitudinal axis of the axle member;

a hydraulic line, said hydraulic line is connected to a rotating connector on one end and sufficiently long to connect to a remote controller on the other end, wherein the remote controller is located a distance from the toilet seat, wherein the hydraulic line powers the rotating connectors, which in turn causes the pin extending from the axle member to turn the axle; and wherein the remote controller can be activated to move the toilet seat from a first position to a second position without requiring user contact with the remote controller, the toilet seat, or the toilet.

2. The compact electronic toilet seat assembly of claim 1, wherein the remote controller comprises a motion detector, said motion detector is configured and adapted to activate the remote controller to move the toilet seat or the toilet seat cover from the first position to the second position.

3. The compact electronic toilet seat assembly of claim 1, wherein the motion detector comprises a first sensor and a second sensor, wherein motion in front of the first sensor triggers an upward movement of the toilet seat and motion in front of the second sensor triggers a downward movement of the toilet seat.

4. The compact electronic toilet seat assembly of claim 1, wherein the remote controller comprises a voice activated control configured and adapted to recognize voice commands such that the toilet seat can be moved from the first position to the second first based on voice commands.

5. The compact electronic toilet seat assembly of claim 1, wherein the remote controller comprises an infrared remote control.

6. The compact electronic toilet seat assembly of claim 1, wherein the wherein the remote controller can be activated to move the toilet seat from the first position to a third position, wherein the third position is positioned between the first position and the second position.

7. The compact electronic toilet seat assembly of claim 1 further comprising a toilet seat cover and a second plurality of connectors, said second plurality of connectors attached to the toilet seat cover and pivotably coupled to the axle member in a manner such that the axle member extends between the second plurality of connectors and rotation of the axle member along a longitudinal axis causes movement of the toilet seat cover.

8. The compact electronic toilet seat assembly of claim 7 wherein the toilet seat and the toilet seat cover can be moved independently without user contact with the toilet seat, the toilet seat cover, or the remote controller.

9. A compact electronic toilet seat assembly attachable to a toilet, comprising:

a toilet seat, said toilet seat having a proximal end and a distal end;

an axle member;

a plurality of connectors attached to the proximal end of the toilet seat and pivotably coupled to the axle member;

a hydraulic line coupled to the axle member, wherein the hydraulic line, when activated, is capable of causing movement of the toilet seat; and an electronic control unit comprising a microprocessor, a motion detector and a voice recognition software, said electronic control unit is adapted to be positioned remote from the toilet so as to prevent contact with water in the toilet, wherein the electronic control unit is configured and adapted to be activated to move the toilet seat from a first position to a second position such that the toilet seat remains in the second position; and wherein the toilet seat can be moved without requiring user contact with the toilets seat or the electronic control unit.

10. The compact electronic toilet seat assembly of claim 9, wherein the electronic control unit is configured and adapted to move the toilet seat from the first position to a third position, said third position is intermediate the first position and the second positions.

11. The compact electronic toilet seat assembly of claim 9, wherein the motion detector of the electronic control unit comprises a first sensor and a second sensor, wherein motion in front of the first sensor triggers an upward movement of the toilet seat and motion in front of the second sensor triggers a downward movement of the toilet seat.

12. A compact electronic toilet seat assembly attachable to a toilet, comprising:

a toilet seat, said toilet seat having a proximal end and a distal end;

a plurality of connectors disposed on the proximal end of the toilet seat;

a hydraulic line, wherein the hydraulic line is coupled to the connector and, when activated, causes the connector to rotatably pivot along a central axis in a manner so as to move the toilet seat in an up and down direction; and a controller housing comprising a microprocessor, said controller housing is adapted to be positioned remote from the toilet, wherein the controller housing comprises a voice activated control configured and adapted to recognize voice commands from a user of the toilet.

* * * * *